United States Patent [19]

Wagener et al.

[11] 4,284,476

[45] Aug. 18, 1981

[54] PROCESS AND APPARATUS FOR UTILIZATION OF THE SENSIBLE HEAT OF HOT COKE FOR DRYING AND PREHEATING COKING COAL

[75] Inventors: Dietrich Wagener; Claus Flockenhaus, both of Essen; Joachim F. Meckel, Heiligenhaus, all of Fed. Rep. of Germany

[73] Assignee: Didier Engineering GmbH, Essen, Fed. Rep. of Germany

[21] Appl. No.: 123,475

[22] Filed: Feb. 21, 1980

Related U.S. Application Data

[63] Continuation of Ser. No. 927,039, Jul. 24, 1978, abandoned.

[51] Int. Cl.[3] ..... C10B 39/02; C10B 39/04; C10B 5/00

[52] U.S. Cl. ..... 201/39; 201/41; 202/227; 34/35; 34/86

[58] Field of Search ..... 201/39, 41, 9; 202/227–229; 34/35, 86; 432/77, 78, 82

[56] References Cited

U.S. PATENT DOCUMENTS

| | | | |
|---|---|---|---|
| 3,728,230 | 4/1973 | Kemmetmueller | 202/228 X |
| 3,809,619 | 5/1974 | Drebes et al. | 202/227 X |
| 3,843,458 | 10/1974 | Kemmetmueller | 201/39 |
| 3,888,742 | 6/1975 | Kemmetmueller | 202/228 X |
| 3,959,084 | 5/1976 | Price | 201/39 |
| 3,992,266 | 11/1976 | Aktay et al. | 201/9 X |
| 4,002,535 | 1/1977 | Albright et al. | 201/9 |
| 4,009,080 | 2/1977 | Kurokawa et al. | 201/39 X |
| 4,053,364 | 10/1977 | Poersch et al. | 201/39 X |
| 4,076,593 | 2/1978 | Koizumi et al. | 201/39 |
| 4,106,998 | 8/1978 | Okada et al. | 201/39 |

FOREIGN PATENT DOCUMENTS

| | | |
|---|---|---|
| 2434827 | 2/1975 | Fed. Rep. of Germany . |
| 2415758 | 2/1976 | Fed. Rep. of Germany . |
| 1334373 | 10/1973 | United Kingdom . |

*Primary Examiner*—Michael S. Marcus

*Attorney, Agent, or Firm*—Wenderoth, Lind & Ponack

[57] ABSTRACT

A heat carrier gas is passed through a coke dry cooling plant in direct contact with hot coke therein to form dry cooled coke while simultaneously increasing the temperature of the heat carrier gas. The heat carrier gas is then passed through a coal preheating plant to directly contact and dry and preheat moist coking coal contained therein. The entire system is open, such that a given quantity of the heat carrier gas passes only once through the dry cooling plant and the coal drying and preheating plant. The heat carrier gas may be a flue gas which is passed directly to the coke dry cooling plant without any preliminary pretreatment, and preferably is a flue gas which is supplied directly from a regenerator or recuperator of a coke oven battery. Alternatively, the heat carrier gas may be in the form of a fuel gas which is inert with respect to the hot coke, for example a waste gas or stack gas supplied from an adjacent metallurgical installation, such as a steel mill.

8 Claims, 1 Drawing Figure

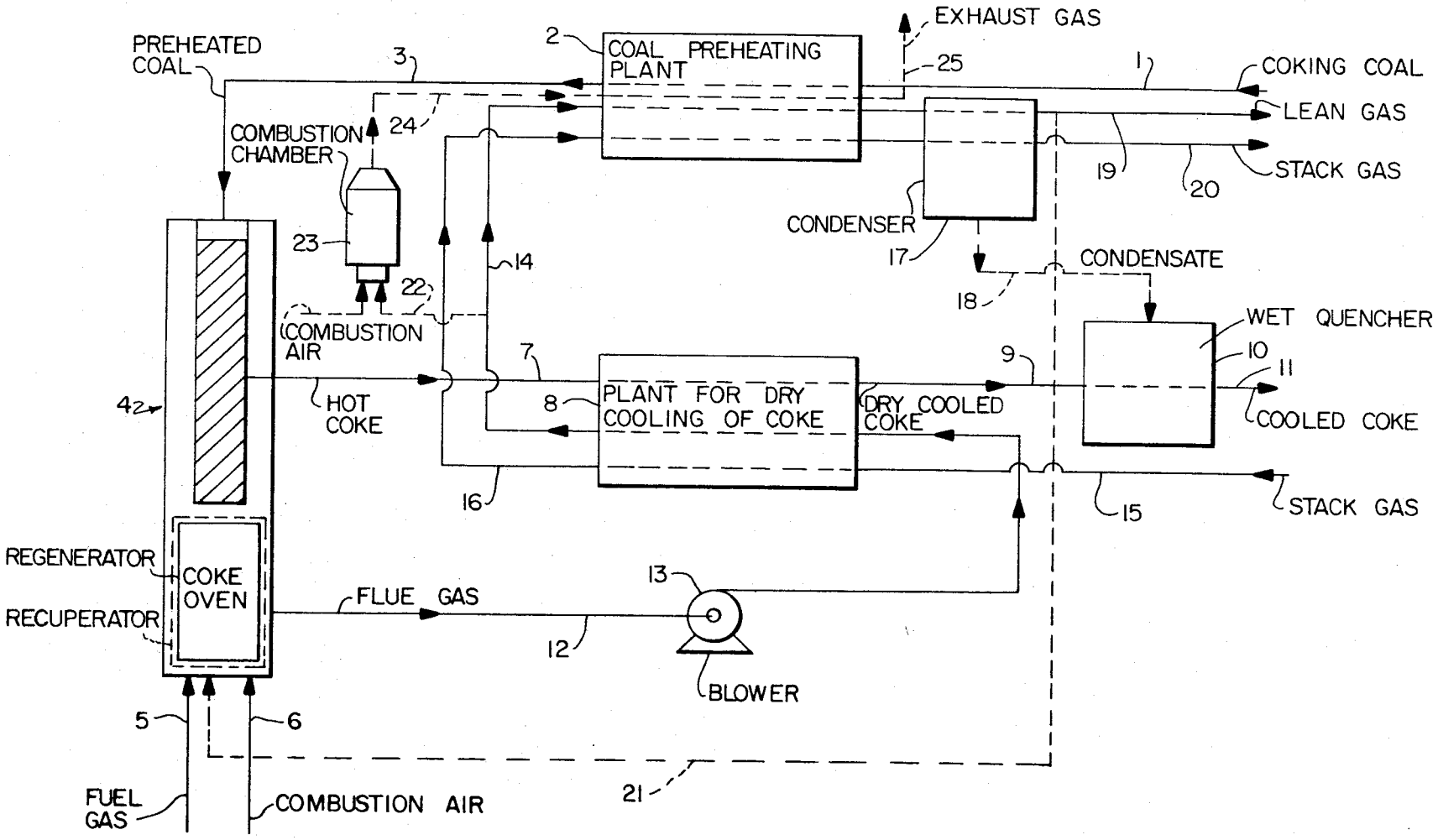
COKING COAL
LEAN GAS
STACK GAS
WET QUENCHER
COOLED COKE
STACK GAS
EXHAUST GAS
CONDENSATE
CONDENSER
DRY COOLED COKE
COAL PREHEATING PLANT
PLANT FOR DRY COOLING OF COKE
BLOWER
COMBUSTION CHAMBER
COMBUSTION AIR
HOT COKE
FLUE GAS
COMBUSTION AIR
PREHEATED COAL
COKE OVEN
REGENERATOR
RECUPERATOR
FUEL GAS
1
2
3
5
6
7
8
9
10
11
12
13
14
15
16
17
18
19
20
21
22
23
24
25
42

PROCESS AND APPARATUS FOR UTILIZATION OF THE SENSIBLE HEAT OF HOT COKE FOR DRYING AND PREHEATING COKING COAL

This is a continuation of application Ser. No. 927,039, filed July 24, 1978, now abandoned.

BACKGROUND OF THE INVENTION

The present invention relates to a process and apparatus for the utilization of the sensible heat of hot coke from a coking installation during the dry cooling of the coke and preheating of moist coking coal, wherein a heat carrier gas is led in succession through the coke cooling plant and then through the coal preheating plant.

German DT-OS No. 24 15 758 discloses an installation combined with a coke dry quenching plant and employed for the continuous drying and preheating of coal while utilizing heat which is transferred from the hot coke to a mixed gas. There is provided a combined quenching gas cycle and drying gas passage, and the combined system includes a device for treating the gas after the drying operation to condense therefrom steam which is released during the drying operation, with there also being provided an after-combustion chamber. This known installation employs the gases produced in the combustion chamber as the heat carrier gas which is circulated in a completely closed cycle. Thus, the heat carrier gas must in this manner be continuously replenished and added to the cycle. This known installation also of necessity includes very spacious components such as dust removers, blowers, injection condensers, heat exchangers and an after-combustion chamber for burning water-gas components from the quenching operation. Accordingly, this known installation is very expensive both with regard to manufacture cost and operating cost.

German DT-OS No. 24 34 827 discloses a process for recovering energy during a gas generation process, for example a coal gasifying or coal coking operation, for the purpose of drying or preheating the starting material, in particular fine coal employed for the coking operation. This known process achieves drying and preheating of the starting material by means of waste heat obtained during the cooling of the solid residues of the process, for example during the dry quenching of coke from a coking plant. More particularly, a primary closed gas cycle derives heat from the cooling of the hot coke, and such primary closed cycle of necessity is equipped with a dust separator. Heat is transferred from this primary closed cycle to a heat transfer and drying agent such as an inert gas, for example nitrogen, a flue gas of a coke oven, or a flue gas obtained from the combustion of a waste gas. The heat transfer and drying agent is maintained in a secondary closed gas cycle which also of necessity includes a dust separator. Due to the fact that this known process employs two separate cycles, such process is expensive with regard to manufacturing cost, inasmuch as it requires numerous expensive components, such as heat exchangers, dust separators and blowers.

British Pat. No. 1,334,373 discloses a system for employing the sensible heat of hot coke produced in a coking operation for the drying and/or preheating of coal. An inert gas is cycled through the hot coke and the coal, and the inert gas may form a portion of the combustion products of the fuel gases that are used for the coking operation. It is necessary to pretreat both the heat carrier gas fed to the coke filling plant in order to render it inert, and also to pretreat the heat carrier gas which is passed to the coal preheating plant.

SUMMARY OF THE INVENTION

With the above discussion in mind, it is a primary object of the present invention to provide an improved process and apparatus for dry cooling hot coke after its discharge from a coke oven battery and for using the sensible heat of the hot coke thus achieved for drying and preheating moist coking coal prior to its introduction into the coke oven battery.

More particularly, the present invention is directed to such an improved process and apparatus which overcome all of the above discussed disadvantages of the prior art.

It is an even further object of the present invention to provide such an improved process and apparatus whereby it is possible to obtain a much more economical utilization of the sensible heat of the hot coke.

These objects are achieved in accordance with the present invention by passing a heat carrier gas through a coke dry cooling plant containing therein hot coke and therein dry cooling the hot coke to form dry cooled coke while simultaneously increasing the temperature of the heat carrier gas. The thus heated heat carrier gas is then passed through a coal preheating plant containing therein moist coking coal, whereby the heat carrier gas transfers its heat to the moist coking coal and thus dries and preheats the moist coking coal. The entire system is maintained open, and the heat carrier gas is not continuously recirculated through the system. A given portion of the heat carrier gas is passed only once through the coke dry cooling plant and the coal preheating plant. The heat carrier gas directly contacts the hot coke in the coke dry cooling plant, and the heat carrier gas further directly contacts the moist coking coal in the coal drying and preheating plant.

In accordance with one preferred embodiment of the present invention, the heat carrier gas comprises a flue gas which is passed directly into the coke dry cooling plant without any preliminary pretreatment. More particularly, the flue gas is supplied to the coke dry cooling plant from a regenerator or recuperator of the coke oven battery, and the flue gas is reacted within the coke dry cooling plant to form a lean gas having a reduced calorific value.

In accordance with an alternative embodiment of the present invention, the heat carrier gas may comprise a fuel gas, such as a waste gas or a stack gas which is ordinarily readily available in any conventionally adjacent metallurgical installation, such as a steel mill operation. After the fuel gas is discharged from the coal drying and preheating plant, it may be returned to the adjacent metallurgical installation.

After the heat carrier gas passes from the coal preheating plant, any moisture which has been absorbed in the heat carrier gas during the drying of the moist coking coal may be condensed by passing the heat carrier gas through a condenser. Similarly, dust may be removed from such heat carrier gas by passing the heat carrier gas after discharge thereof from the coal preheating plant through a dust separator. The condensate which is thus obtained in the condenser stage may be used as a quenching agent in a wet quencher which is used to further quench the dry cooled coke after the discharge thereof from the coke dry cooling plant.

After the heat carrier gas has been discharged from the coal drying and preheating plant, it may be employed for various uses in the overall installation. Specifically, the heat carrier gas may be employed as an undergrate firing gas in the coke oven battery itself, as a carburetion gas for the undergrate firing gas, or for other carburetion or undergrate firing purposes for the overall metallurgical installation.

When the heat carrier gas is not intended to be employed for any further use after the drying and preheating of the coking coal, then the heat carrier gas, after discharge from the coke dry cooling plant, may at least in part be passed to a combustion chamber wherein the heat carrier gas is burnt and transformed into an inert heat carrier gas. The heat carrier gas is preferably maintained under pressure to prevent the penetration of oxygen into the system.

Accordingly, in accordance with the present invention the entire system is maintained in a single open cycle rather than in a closed and possibly plural cycle system as is conventional in prior art devices. Since the heat carrier gas, whether a flue gas or a fuel gas, is continuously produced and is thus constantly and readily available, the heat carrier gas is led only a single time through the various stages of the open cycle of the system of the present invention. Therefore, it is completely unnecessary to provide the system with means for continuously regenerating or recirculating the heat carrier gas. Such replacement is required in closed prior art installations which inherently develop leaks.

BRIEF DESCRIPTION OF THE DRAWING

Other objects, features and advantages of the present invention will be apparent from the following detailed description, taken with the accompanying single drawing FIGURE which schematically illustrates one embodiment of the various features of the process and apparatus of the present invention.

DETAILED DESCRIPTION OF THE INVENTION

With reference now to the drawing, coking coal is supplied in a known manner, as illustrated schematically at 1, to a coal preheating plant 2 and is dried and preheated therein in a manner to be described in more detail below. The dried and preheated coal is then supplied as at 3 and in a conventional manner to a conventional coke oven battery 4 including conventional coke ovens, conventional regenerators and conventional recuperators. Fuel gas and combustion air are supplied to the coke oven battery in a known manner, as schematically shown at 5 and 6, respectively. After the formation of coke in the coke oven battery, hot coke is removed in a conventional manner as shown at 7 and is supplied to a plant 8 for the dry cooling of the coke. The dry cooling of the coke will be described in more detail below. The dry cooled coke is then transferred from plant 8 in a conventional manner as at 9 and may be passed through a wet quencher 10 to be further cooled. The finally cooled coke is then removed as at 11 for further use in a known manner as will be understood by those skilled in the art.

The above described features are all conventional, and therefore no further description thereof is necessary.

However, in accordance with the present invention, there is provided a novel process and apparatus for utilizing the sensible heat of the hot coke which is removed from the coke oven battery 4 to both dry cool the coke in plant 8 and to dry and preheat the moist coking coal in the coal preheating plant 2. More particularly, a single heat carrier gas is passed in a completely open system, without any initial pretreatment of such heat carrier gas, through both the coke dry cooling plant 8 to thereby dry cool the coke, and then through the coal preheating plant 2 to dry and preheat the moist coking coal.

In accordance with one specifically preferred embodiment of the present invention, flue gas from a regenerator or recuperator of the coke oven battery is supplied directly, as shown at 12, and by means such as blower 13, to the coke dry cooling plant 8. The flue gas is not in any way pretreated prior to its introduction into plant 8. The flue gas is brought into direct contact with the hot coke within plant 8. Since the flue gas enters the plant 8 at a temperature of approximately 200° to 250° C., and since the hot coke is at a much higher temperature as will be understood by those skilled in the art, the flue gas will be substantially heated, while at the same time the hot coke will be substantially cooled. Additionally, since the flue gas leaving the regenerator or recuperator of the coke oven battery possesses both a substantial steam content and also a residual oxygen content, contact of the flue gas with the hot coke will result in an endothermal water to gas reaction, i.e. steam to $H_2$ and CO, as well as an exothermal partial oxidation. Due to the predominance of the water to gas reaction, the overall effect will be strongly endothermal, and the endothermal nature of this overall reaction also strongly contributes to the cooling of the coke. This reaction results in the transformation of the relatively warm flue gas into a much hotter lean gas, having a lower calorific value than the flue gas, which leaves the plant 8 at a temperature of generally approximately 500° to 800° C., and preferably at a temperature above 600° C. Steam and oxygen are not removed from the flue gas.

The lean gas which is produced from the flue gas in the plant 8 and which is heated therein is led from the plant 8 as at 14 into the coal preheating plant 2 and into direct contact with the moist coking coal therein, whereby the hot lean gas dries and preheats the coking coal to a temperature of more than 100° C. The thereby cooled lean gas is then discharged from coal preheating plant 2.

In an alternative embodiment of the present invention, flue gas from the regenerator or recuperator of the coke oven battery is not employed as the heat carrier gas. Rather, a readily available fuel gas, such as a waste gas or a stack gas which is ordinarily readily available in any steel mill operation is employed as the heat carrier gas and is supplied as schematically shown at 15 to the coke dry cooling plant 8. Such waste gas or stack has a conventional and known composition and is inert to the hot coke such that it will not react with the hot coke during the dry cooling operation within plant 8. Such stack gas is passed through plant 8 in direct contact with the hot coke therein. The stack gas is supplied at a relatively cool temperature such that it dry cools the hot coke, and the stack gas is accordingly heated. The thus heated stack gas is supplied at 16 to the coal preheating plant 2 and is passed therein in direct contact with the moist coking coal, such that the stack gas yields its heat to the coking coal, thus heating the coking coal to a temperature above approximately 100° C., while simultaneously absorbing water from the coking coal. The thus cooled stack gas is then removed from the coal preheating plant 2.

After the heat carrier gas, i.e. either the lean gas or the stack gas, passes from the coal preheating plant 2, it may be freed of any absorbed water in a condensation stage and/or of dust in a fine dust separation stage. Specifically, as shown in the drawing, either the lean gas or the stack gas may be passed through a condenser 17 to remove any water which has been absorbed during the drying and preheating of the coking coal in the plant 2. In accordance with a further feature of the present invention, the condensate removed from the lean gas or stack gas in the condenser 17 may be supplied as at 18 to the wet quencher 10 in carrying out a further cooling of the coke. It will further be understood that the condenser 17 may operate in a known manner to remove fine dust from the lean gas or stack gas. Alternatively, a separate conventional dust separator (not shown for purposes of clarity), may be provided for removing fine dust from the lean gas or stack gas.

The lean gas or stack gas may then be removed as at 19 and 20, respectively, for known uses or purposes.

Specifically, the lean gas may be used, as indicated at 21, as an undergrate firing gas in the coke oven battery itself, as a carburetion gas for the undergrate firing gas, or for other carburetion or undergrate firing purposes for the overall steel mill or other metallurgical installation, as will be apparent to those skilled in the art. Similarly, the stack gas at 20 could also be employed for such carburetion and/or undergrate firing purposes. Additionally, the stack gas from 20 could be returned to the original source or stack gas pipe 15. This would mean that the stack gas would not have to be purified, dried or cooled in a heat exchanger, as would otherwise be necessary if such stack gas were to be merely discharged to the atmosphere.

When the lean gas which is produced during the dry cooling of the coke in the plant 8 is not to be employed for any further use after the drying and preheating of the coking coal, then it is possible for such lean gas to be supplied at least in part to a combustion chamber wherein the lean gas is burnt and transformed into an inert heat carrier gas for use in the coal preheating plant 2. Specifically, at least a portion of the lean gas from 14 may be supplied as at 22 to a combustion chamber 23 wherein the lean gas is burnt and transformed into an inert heat carrier gas which is then supplied as at 24 to coal preheating plant 2 to therein dry and preheat the coking coal in the manner described above. When the lean gas is thus burnt in combustion chamber 23 to form an inert heat carrier gas, then it is not necessary to pass such gas through condenser 17. Accordingly, after discharge from coal preheating plant 2, such gas may be discharged as at 25 as exhaust gas. Additionally, it should be understood that in a similar manner at least a portion of the hot stack gas may be supplied from 16 to combustion chamber 23.

As long as the heat carrier gas is in the form of the lean gas or a fuel gas such as the stack gas, then the heat carrier gas should be passed through the above described open system under pressure sufficient to prevent the penetration of oxygen into the system.

As will be apparent from the above description, a particular advantage of the process and apparatus of the present invention is that the heat carrier gas, i.e. either the flue gas from the coke oven battery or the stack gas from a readily available steel mill source, is passed both through the coke dry cooling plant 8 in direct contact with the glowing coke and also through the coal preheating plant 2 in direct contact with the coking coal in a single open cycle, rather than in a closed cycle as is conventional in the prior art. Since the flue gas is continuously produced and is thus constantly available, and since the stack gas is also constantly available from adjacent systems of the overall metallurgical operation, the heat carrier gas is led only a single time through the various stages of the open cycle of the system. Therefore, it is totally unnecessary to provide the system with means for continuously regenerating or recirculating the heat carrier gas to provide a continual replacement therefor. Such replacement means have of course been required in prior art installations employing closed cycles that unavoidably develop leaks.

A further advantage of the present invention is that the lean gas produced from the flue gas of the coke oven battery, and also the stack gas, inherently have a relatively low water content and thus act with a low water content on the moist coking coal in the coal preheating plant. Also, combustion of the lean gas in chamber 23 forms an inert heat carrier gas having a water content which is far lower than fuel gases such as coke oven gas, natural gas, and the like.

Accordingly, in all embodiments of the present invention, the ratio of the water content of the moist coking coal to the water content of the particular heat carrier gas employed is very high, and is specifically much higher than in known pneumatic coal drying processes. It will of course be readily apparent that such high water content ratios are particularly advantageous for the actual coal drying operation.

Therefore, in view of the above discussion, it will be apparent that the process and apparatus of the present invention utilize with great economy the waste heat of the solid residues of the coking operation. The released heat carrier gas from the coal drying and preheating operation may be again employed for a very great variety of purposes, such as undergrate firing purposes and the like. By employing a single heat carrier gas for all stages of the process, it is not necessary to employ a fine dust separator subsequent to the coke dry cooling operation. Therefore, it will be apparent that the system of the present invention employs fewer components than are necessary in prior art installations and that thus the system of the present invention is less expensive.

It is to be understood that with the exception of the above discussed novel features of the present invention, the various other components and elements of the system of the present invention are intended to be conventional. For example, the coke oven battery 4 and the various elements thereof, including coke ovens, regenerators and recuperators, may be any such known structural element, with the exception of the novel features of the present invention as hereinabove discussed. Furthermore, the coke dry cooling plant 8, the coal preheating plant 2, the wet quencher 10, the condenser 17, and the combustion chamber 23 may also be conventional and commercially avaiable such items, with the exception that such elements are modified as necessary to be employed in the overall system of the present invention as discussed hereinabove.

Although the process and apparatus of the present invention have been described and illustrated with respect to preferred features thereof, it will be apparent that various modifications may be made to such features without departing from the scope of the present invention.

What we claim is:

1. A process for dry cooling hot coke after its discharge from a coke oven battery and for drying and preheating moist coking coal prior to its introduction into said coke oven battery to be formed therein into coke, said process comprising:

withdrawing stack gas from a metallurgical installation adjacent to a coke oven battery and directly passing said stack gas through a coke dry cooling plant containing hot coke and therein directly contacting said stack gas with said hot coke and dry cooling said hot coke to form dry cooled coke while simultaneously increasing the temperature of said stack gas;

then passing said stack gas through a coal preheating plant containing moist coking coal and therein directly contacting said stack gas with said moist coking coal and drying and preheating said moist coking coal by transfer of heat thereto from said stack gas; and maintaining said stack gas in an open system by passing given said stack gas only once through said coke dry cooling plant and said coal preheating plant and not continuously circulating such given stack gas therethrough.

2. A process as claimed in claim 1, further comprising, after discharge of said stack gas from said coal preheating plant, condensing from said stack gas moisture absorbed thereby during dyring of said moist coking coal.

3. A process as claimed in claim 2, further comprising wet quenching said dry cooled coke with said moisture condensed from said stack gas.

4. A process as claimed in claim 2, further comprising separating dust from said stack gas after discharge thereof from said coal preheating plant.

5. In a system including a coke oven battery for receiving therein coal for the formation of coke, and a metallurgical installation adjacent said coke oven battery, the improvement of an apparatus for dry cooling hot coke after its discharge from said coke oven battery and for drying and preheating moist coking coal prior to its introduction into said coke oven battery to be formed therein into coke, said apparatus comprising:

a coke dry cooling plant positioned to receive therein hot coke from said coke oven battery;

a coal drying and preheating plant adapted to receive therein moist coking coal prior to the introduction thereof into said coke oven battery; and the interiors of said coke dry cooling plant and said coal drying and preheating plant forming portions of an open system which includes means for withdrawing stack gas from said metallurgical installation and directly passing said stack gas through said coke dry cooling plant and therein directly contacting said stack gas with said hot coke and dry cooling said hot coke to form dry cooled coke while simultaneously increasing the temperature of said stack gas, and then passing said stack gas through said coal drying and preheating plant and therein directly contacting said stack gas with said moist coking coal and drying and preheating said moist coking coal by transfer of heat thereto from said stack gas, said open system being incapable of continuously recirculating therethrough given said stack gas.

6. The improvement claimed in claim 5, further comprising means for condensing from said stack gas, after discharge thereof from said coal drying and preheating plant, moisture absorbed by said stack gas during drying of said moist coking coal.

7. The improvement claimed in claim 6, further comprising a wet quencher positioned to further quench said dry cooled coke after discharge thereof from said coke dry cooling plant, and means for employing said moisture condensed from said stack gas by said condensing means as the quenching agent of said wet quencher.

8. The improvement claimed in claim 6, further comprising means for separating dust from said stack gas after discharge thereof from said coal drying and preheating plant.

* * * * *